US006041969A

United States Patent [19]

Parise

[11] Patent Number: 6,041,969

[45] Date of Patent: Mar. 28, 2000

[54] CONTAINER FOR CONCENTRATED POWDER OR LIQUID SUBSTANCES TO BE PUT IN SOLUTION WITHIN AN ENCLOSURE AT THE TIME OF USE

[76] Inventor: Bernardino Parise, Via Mantegna 6/4, 36063 Marostico, Vicenza, Italy

[21] Appl. No.: 09/095,505

[22] Filed: Jun. 10, 1998

[30] Foreign Application Priority Data

Jun. 10, 1997 [IT] Italy ..... VI97A0091

[51] Int. Cl.[7] ..... B67D 5/60

[52] U.S. Cl. ..... 222/129; 222/383.1; 215/DIG. 8; 206/219

[58] Field of Search ..... 222/129, 136, 222/383.1; 206/219, 568, 221; 215/6, DIG. 8

[56] References Cited

U.S. PATENT DOCUMENTS 3,655,096 4/1972 Easter ..... 215/6

4,705,191 11/1987 Itzel et al. ..... 222/136

5,421,483 6/1995 Parise ..... 222/129

FOREIGN PATENT DOCUMENTS 1188018 8/1985 Italy .

*Primary Examiner*—Kevin Shaver
*Assistant Examiner*—J P Welsh
*Attorney, Agent, or Firm*—Bucknam and Archer

[57] ABSTRACT

A container for concentrated powder or liquid substances to be put in solution within an enclosure at the time of use is made of three elements, essentially hollow and with cylindrical shape and arranged coaxially, assembled by mechanical engagement in correspondence with zones of different diameter. The elements define internally, in their intermediate space, a watertight chamber in the shape of a cylindrical crown in correspondence with their reciprocal precise axial positioning.

5 Claims, 4 Drawing Sheets

CONTAINER FOR CONCENTRATED POWDER OR LIQUID SUBSTANCES TO BE PUT IN SOLUTION WITHIN AN ENCLOSURE AT THE TIME OF USE

FIELD OF INVENTION

This invention relates to a container for concentrated powder or liquid substances to be put in solution within an enclosure at the time of use.

BACKGROUND OF THE PRIOR ART

It is known that sometimes concentrated substances need to be preserved, usually in the form of a liquid or powder, which are dissolved in a solvent, generally composed of water, only at the time they are used.

Typically this occurs, for example, in the domestic area for advance preparation of fertilizers, herbicides or other similar solutions.

The fact that these substances can be kept in sealed containers enables the following advantages: first, a bottle or similar container can be filled with the desired solution only when there is an actual need to use it, and second, many of the substances mentioned above tend to deteriorate over time once they are put in solution, but retain their quality for extremely long periods of time if kept in an essentially airtight package.

Industrial patent no. 1,188,018 and patent application no. V192A000192 describe a container comprised of a pair of essentially hollow elements having a cylindrical shape, one of which is located inside the other, and which are assembled by mechanical engagement in correspondence with two zones of different diameter; said elements define internally, in their intermediate space, a watertight chamber in the shape of a cylindrical crown in correspondence with their reciprocal precise axial positioning.

This container is especially suitable for being fitted to the mouth of a bottle.

As claimed in the invention, the internal element can be slid in an axial direction with respect to the external element, while the latter remains fixed to the aforementioned mouth; this is easy to do while screwing down the ring nut of a sprayer capable of ejecting the solution from the bottle.

This causes the ejection of the concentrated substances from the aforementioned chamber and consequently their dropping into the bottle, causing mixing of the substances with the solvent which fills the bottle.

Thus, all the user need do is acquire the container containing the liquid which he needs, which requires an extremely small amount of space due to the high concentration of its contents, with application as a matter of general principle to any bottle, enclosure or the like.

It is also evident that given the small space occupied by a single container, it is very useful and simple for the user to acquire and keep a plurality thereof, not to mention that for the industry which produces concentrated substance it is easier to market a substance in a small container than it is to market the substance in a large bottle or the like.

However, the containers manufactured in the aforementioned other patents have the disadvantages which arise both in the phase of manufacturing the individual pieces which are to form the container itself and during use of the container, when it is applied to the bottle or the like.

Specifically, the container described in patent no. 1,188,018 is not sufficiently tight relative to the discharge of the substance from between the two aforementioned cylindrically shaped elements, due to the smallness of the surfaces which intervene in correspondence with the zone of greater diameter.

The container described in patent application no. VIA92000192, however, has a movable element provided with radial projections. This makes it complicated to manufacture using the injection molding technique, and moreover requires considerable effort to open, which takes place by widening and opening the discharge hole, not to mention the need to use a considerable amount of plastic material and the disadvantage of the volume of the aforementioned watertight chamber.

SUMMARY OF THE INVENTION

The object of this invention is a container characterized by security, functionality, ease of manufacture and with limited consumption of materials in its manufacture, which is considerably superior to known devices of this type and in particular to the devices cited above.

The object is achieved with a container comprised of three substantially hollow elements with cylindrical shape, coaxial and reciprocally assembled by mechanical engagement in correspondence with three zones of different diameter, in such a way as to define in their intermediate space a watertight chamber in the form of a cylindrical crown.

In terms of construction, the first cylindrically symmetrical element has a bottom with an axial hole in its lower part.

The second cylindrically symmetrical element is situated inside the first element and is comprised of a collar in the shape of an inverted cup, from the bottom of which projects a last coaxial cylindrical element towards the bottom of the aforementioned first element.

The outside diameter of the collar is such that it can slide inside the first element with engagement in such a way as to obtain a watertight fit.

The third element is a ring which threads onto the end of the cylindrical element projecting from the second element and when tightened until locked forms a single piece with this second element.

The external diameter of the ring allows it to slide within the hole in the bottom of the first element with engagement in such a way as to obtain a watertight fit.

After assembling the three elements, the container made in this way is composed of two parts, the first composed of the first element placed externally, and the second placed internally and coaxial with the aforementioned first element, composed of the second and third elements.

In correspondence with a precise position of the second part with respect to the first, the aforementioned collar and ring close the two ends opposite the intermediate space which comprises the watertight chamber in the shape of a cylindrical crown into which the concentrate has been previously poured.

The possibility of axially sliding the internal part with respect to the external part towards the bottom of the first element determines the axial shift of the ring which, completely emerging from the first part, clears the hole from the bottom of the latter, allowing as a consequence the concentrated substance to leave the aforementioned chamber and as a result its dropping into the underlying bottle.

Finally, the invention has on the internal surface of the first element at least one microprojection which, defining a microdeformation of the external surface of the collar when the latter completely enters the first element, forms a channel which places the top part of this chamber in contact with the outside, thereby facilitating the emptying of concentrated substance from its lower part.

BRIEF DESCRIPTION OF THE DRAWINGS

These and other characteristics of the invention are described in detail below with reference to a particular embodiment, given by way of non-restrictive example, with the aid of the attached figures, wherein.

Figure 1:
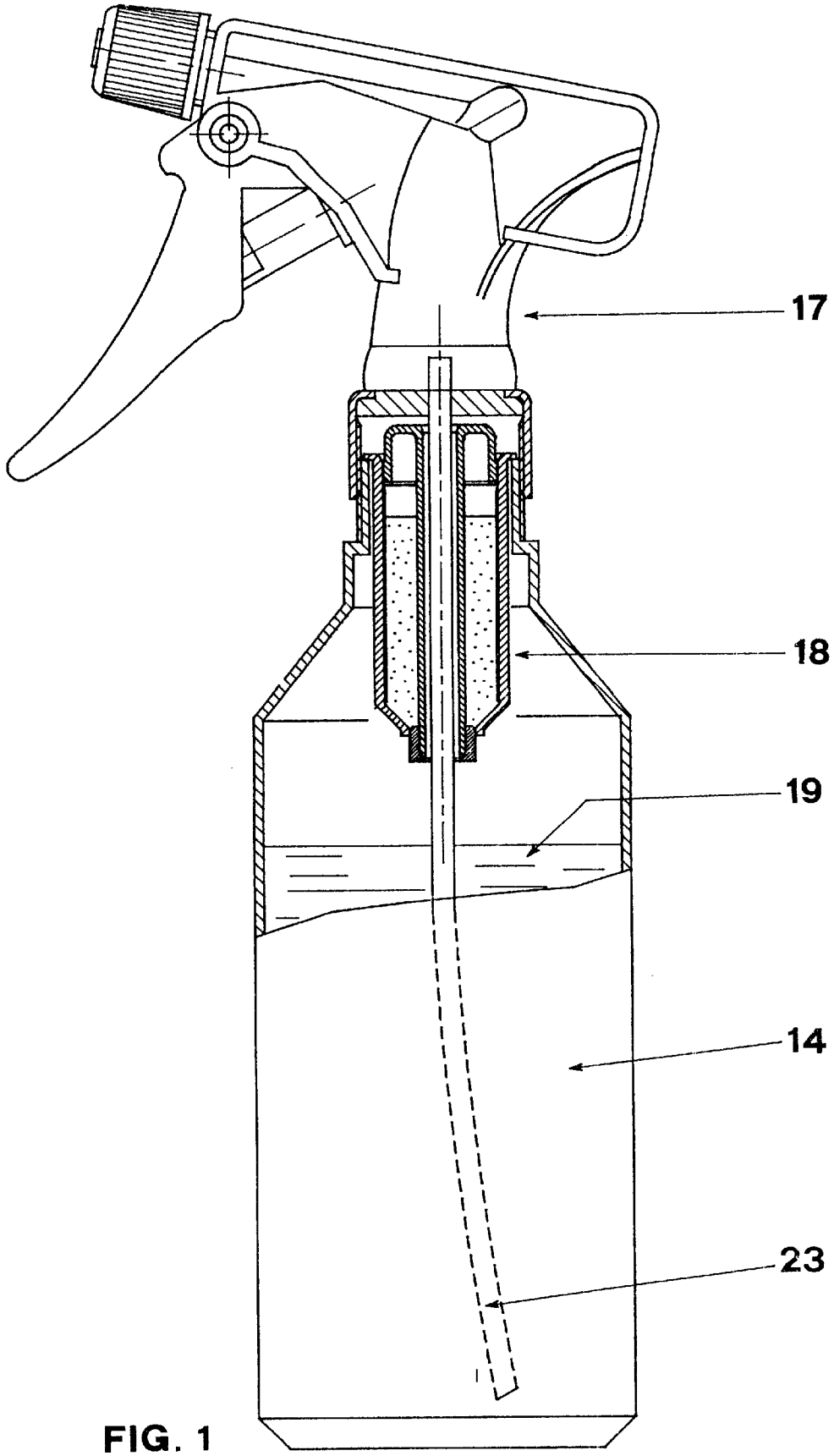
FIG. 1 shows a longitudinal cross-section of the container according to the invention, applied to a bottle, equipped with a sprayer on top, in the closed or watertight position.

As shown in the attached figures, the container of the invention is composed of three elements 1, 2 and 3, all of essentially cylindrical shape; in particular, elements 2 and 3 are capable of being inserted coaxially into element 1. The latter has, in correspondence with its lower part, bottom 4 in whose central part hole 5 is made axially.

Element 2 has collar 6 in the shape of an inverted cup, and from the latter final projecting element 7 projects towards hole 5 of element 1.

Element 3 is a ring with central hole 8 which allows the ring to be threaded and locked onto terminal portion 9 of aforementioned projecting element 7, forming a single piece with element 2.

Figure 7:
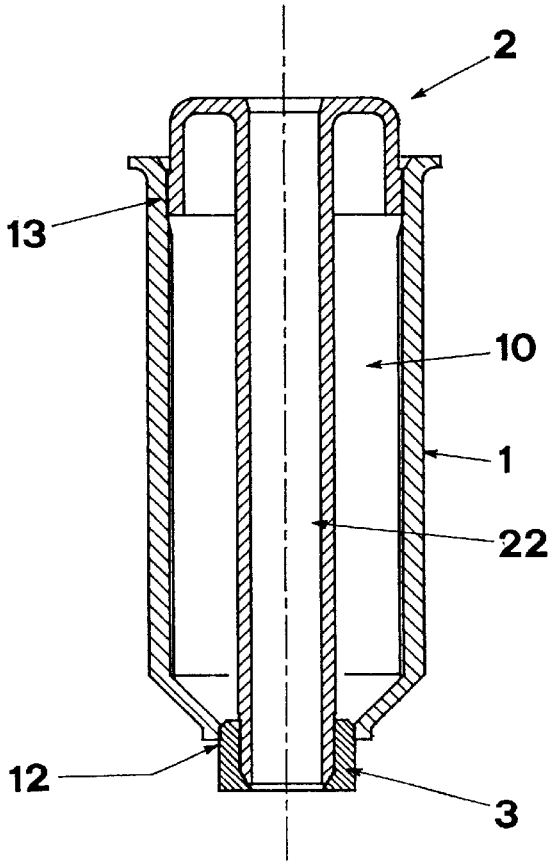
FIG. 7 shows a longitudinal cross-section of the container in the closed or watertight position.
Figure 3:
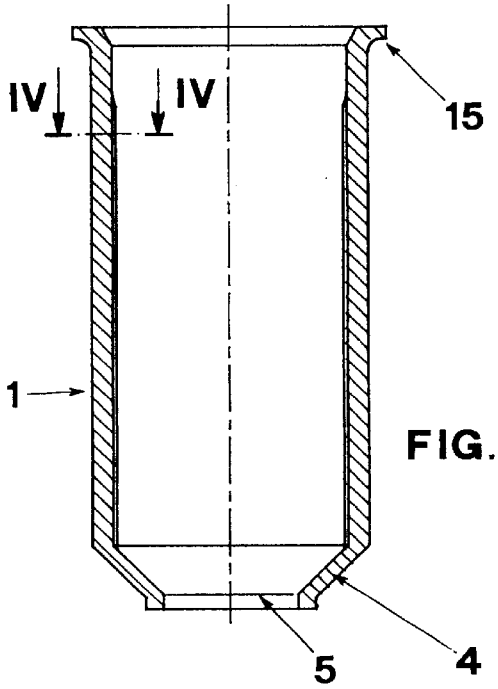
FIG. 3 shows a longitudinal cross-section of the first cylindrically symmetrical element present in the device of the invention.
Figure 4:
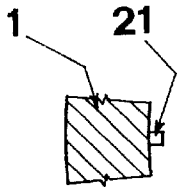
FIG. 4 shows a detailed view cut away along line IV—IV shown in FIG. 3.
Figure 6:
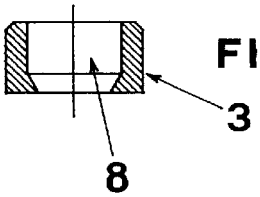
FIG. 6 shows a longitudinal cross-section of the third cylindrically symmetrical element present in the device of the invention.
Figure 10:
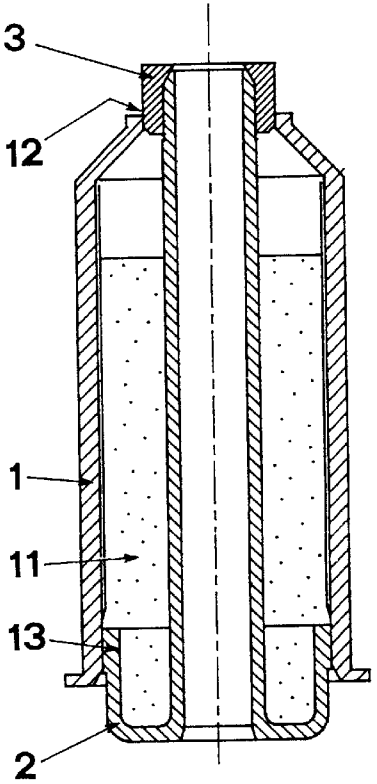
FIG. 10 shows the assembly phase of the third element for closure of the container.
Figure 9:
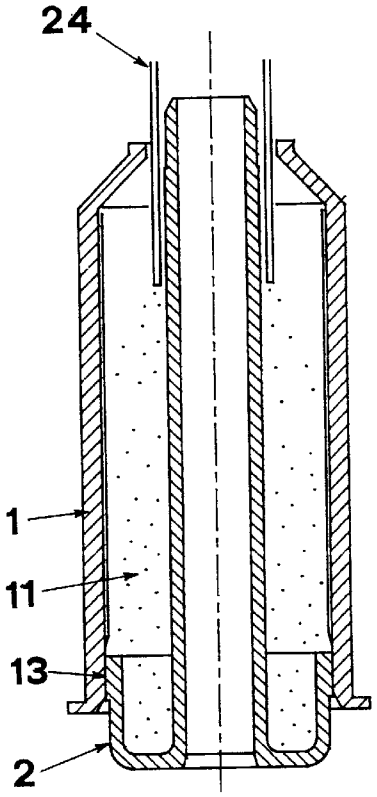
FIG. 9 shows a longitudinal cross-section of the phase in which the concentrate is injected into the container.
Figure 8:
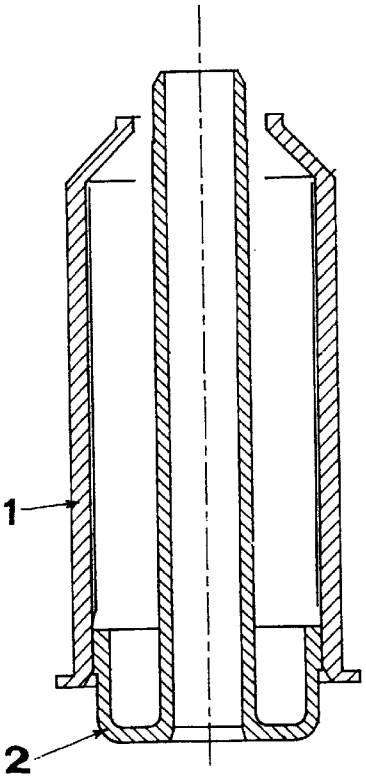
FIG. 8 shows a longitudinal cross-section of the reciprocal assembly phase of the first and second elements to form the container.

As is obvious from FIGS. 7 and 10, in correspondence with a precise position of elements 2 and 3 (joined together) with respect to external element 1, intermediate space 10 is formed which can accommodate concentrate 11 in the form of powder or liquid.

The particular size (upon engagement) of the external diameter of element 3 and of hole 5, present on bottom 4 of element 1, makes it possible in reciprocal contact zone 12 to ensure that substance 11 is contained in a watertight manner (see FIG. 7).

Likewise, the particular size (upon engagement) of the external diameter of collar 6 and of an upper part of the internal cylindrical surface of element 1 makes it possible in reciprocal contact zone 13 to ensure that substance 11 is contained in a watertight manner (see FIG. 10) when the container is being filled.

The container of the invention can, as shown in FIG. 1 by way of example, be put fitted to the upper mouth of bottle 14 containing a solvent, for example, water.

In this case, advantageously the upper portion of element 1 will be shaped like a collar or flange 15 which rests on the top edge of said mouth.

Figure 2:
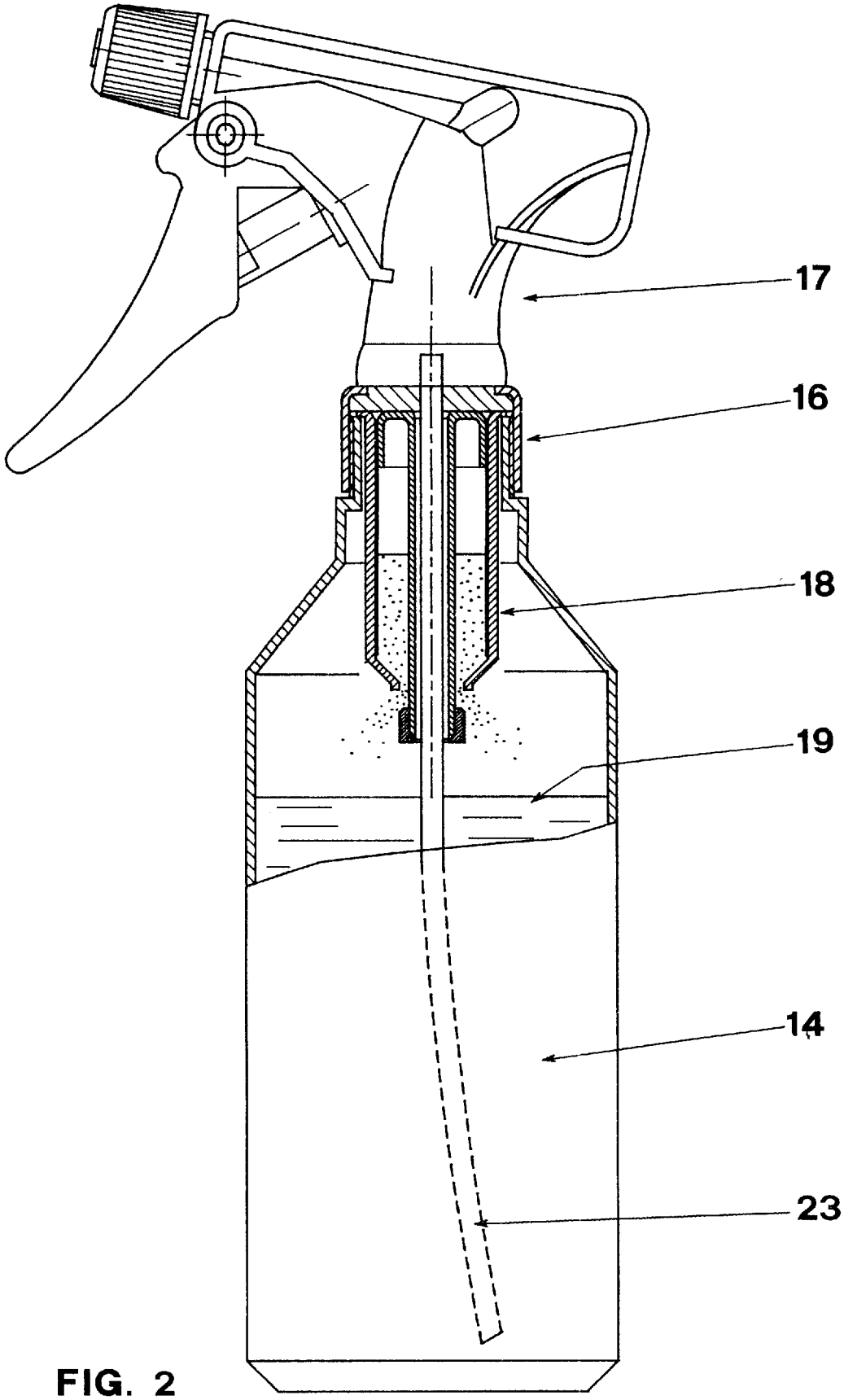
FIG. 2 shows the same view with the container in the open position in such a way as to allow the concentrated substance inside it to be discharged.
Figure 5:
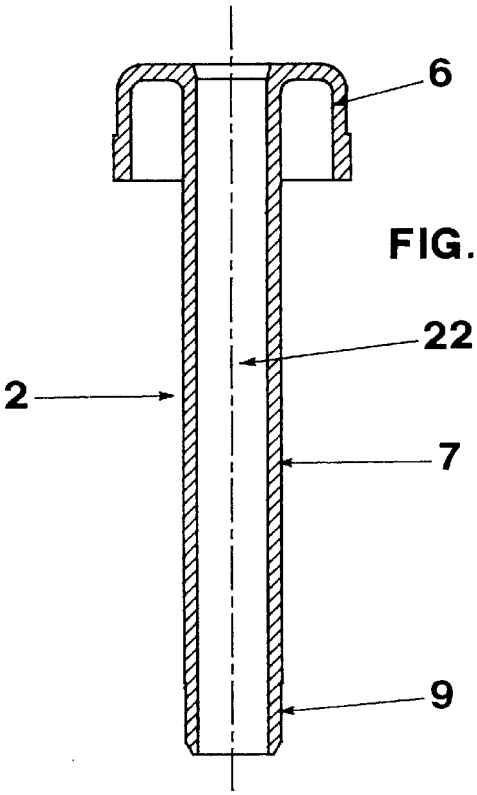
FIG. 5 shows a longitudinal cross-section of the second cylindrically symmetrical element present in the device of the invention.

As shown in FIGS. 1 and 2, when ring 16 of sprayer 17 is screwed onto the threaded mouth of bottle 14, an opening is formed toward the bottom of container 18, in such a way that the substance it contains within will drop into underlying solvent 19 contained in the bottle.

Figure 11:
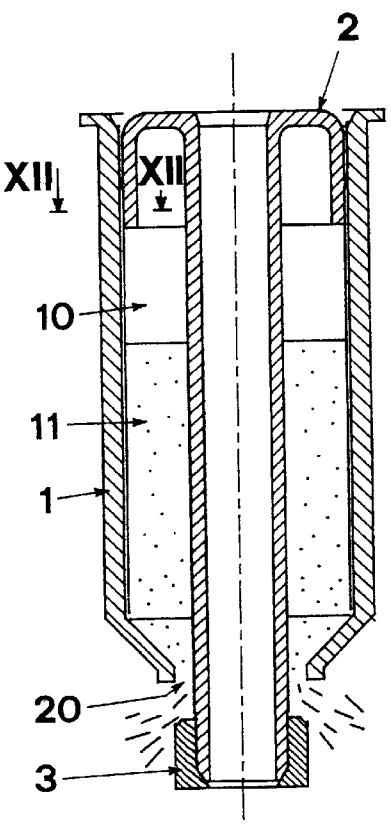
FIG. 11 shows a longitudinal cross-section of the container in the open or emptying position.

More specifically, this is due to the fact that following axial shift towards the bottom of element 2, following the push caused by said ring 16 on collar 6, element 3, joined to said element 2, is moved away from bottom 4 of element 1, forming a circular opening 20 which allows discharge of substance 11 from container 18 (see FIG. 11).

The emptying action from intermediate space 10 is promoted by putting the top part of the aforementioned into contact with the outside in such a way as to eliminate the effects of the so-called opposite cavity.

Figure 12:
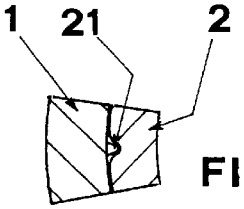
FIG. 12 shows a detailed view cutaway along line XII—XII depicted in FIG. 11.

This is done by the presence on the internal wall of element 1 of at least one microprojection 21 which defines a deformation of the external surface of collar 6 when the latter, pushed by ring 14, enters element 1 (see FIG. 12).

Finally, inside projecting element 7 there is advantageously channel 22 which allows the internal part of bottle 14 or the enclosure to which the container is applied with the outside to be put into communication, said channel allowing passage of hollow needle 23 used for the operation of sprayer 17.

The container 18 of the invention can be applied as well to a bottle or similar object without a sprayer.

As demonstrated above, there are numerous advantages deriving from adoption of the container according to the invention.

A first advantage derives from the simplified geometry of the three elements, for which reason the molding of these parts can be done very quickly.

A second advantage relates to the operation of filling with the concentrate which can be done by using injectors 24 with vertical needles, considerably simplifying this operation.

In addition, the force required to open the container is minimal, since all that need be done is to overcome the resistance of the engagement coupling between hole 5 of element 1 and element 3, in reciprocal contact zone 12.

Finally, considering that the containers before use can be kept in very many different places, in case of their exposure to the sun or while sitting in the heat, the watertightness of intermediate space 10 is always ensured.

In the container of the invention, watertightness is ensured since in the case of heating the area contained in the intermediate space exerts maximum pressure on collar 6, where however the watertight surface 13 is considerable.

I claim:

1. A container for concentrated powder or liquid substances (11) to be put in solution in an enclosure at the time of use, which comprises three elements (1), (2) and (3); said elements being essentially hollow and having cylindrical symmetry and being arranged coaxially, assembled by mechanical engagement in correspondence to zones of different diameter, said elements defining internally, in their intermediate space, a watertight chamber (40) having the shape of a cylindicral crown in correspondence with their reciprocal precise axial positioning, said first element (1) having in the lower part thereof a funnel-shaped bottom (4) with a hole (5) axially located, and having an internal surface, said second element (2) being located in the interior of said first element and having a collar (6) in the shape of an inverted cup from the opposite part with respect to said bottom (4) of the said first element, said collar having a bottom, a projecting element (7) projecting from the bottom of said collar towards said hole (5), the third element (3) comprising a ring having a central hole (8), said projecting element (7) having a terminal part (9), said third element (3) being locked by engagement on said terminal part (9) of said projecting element (7), said third element (3) forming a single piece with said second element (2), said collar (6) having an external surface, said third element (3) having an external surface, the external surface of said element (3) mechanically engaging said surface of said hole (5) and the external surface of collar (6) mechanically engaging said internal surface of said first element (1), creating two watertightness zones (12, 13) for intermediate space (10) containing said concentrate (11).

2. The container according to claim 1 wherein said first element (1) is located externally of said second and third element, has an interior and contains in said interior the second element (2) and said third element (3), each said first and second elements comprising a single body which, sliding axially, removes said third element (3) from said hole (5) causing emptying of said intermediate space (10).

3. The container according to claim 1, wherein on said internal surface of said first element (1) is located at least one microprojection (21) which deforms said external surface of said collar (6) when said collar enters said first element (1).

4. The container according to claim 1 which during use is fitted with a bottle (14) containing a solvent (19), said bottle having a threaded upper mouth, said mouth having a top edge, said first element (1) has an upper portion which is shaped as a flange (15), and said flange rests during use on said top edge.

5. The container according to claim 4 wherein said bottle is provided with sprayer (17), said sprayer having a ring (16), and during use said ring is screwed onto said threaded mouth of said bottle, thereby axially moving said collar (6) projecting element (7) and third element (3), whereby a hole (5) is opened in the bottom of said container and substance (11) drops into said solvent.

* * * * *